US006440294B1

(12) United States Patent
Cotten

(10) Patent No.: US 6,440,294 B1
(45) Date of Patent: Aug. 27, 2002

(54) CRUST HOLE REPAIR FOR ELECTROLYTIC CELLS

(75) Inventor: H. Wayne Cotten, Rockdale, TX (US)

(73) Assignee: Alcoa Inc., Pittsburgh, PA (US)

( * ) Notice: Subject to any disclaimer, the term of this patent is extended or adjusted under 35 U.S.C. 154(b) by 0 days.

(21) Appl. No.: 09/408,868

(22) Filed: Sep. 29, 1999

(51) Int. Cl.[7] ..... C25C 3/14; C25C 3/00; C25C 3/06; B01D 59/40

(52) U.S. Cl. ..... 205/367; 205/392; 205/396; 205/372; 205/389; 205/394; 204/243.1; 204/245

(58) Field of Search ..... 204/243.1, 247.4, 204/243 R, 245; 266/280; 75/301, 776; 205/392, 396, 367, 394, 372, 389

(56) References Cited

U.S. PATENT DOCUMENTS 1,534,315 A * 4/1925 Hoopes ..... 204/245 X
1,837,070 A * 12/1931 Roth ..... 204/245 X
3,016,340 A * 1/1962 Hygen et al. ..... 205/392
4,396,481 A 8/1983 Pawlek et al. ..... 204/243
4,617,100 A 10/1986 Boughton ..... 204/245
4,770,752 A 9/1988 Gianfranco ..... 204/67

FOREIGN PATENT DOCUMENTS

SU 458624 1/1975

* cited by examiner

*Primary Examiner*—Donald R. Valentine
(74) *Attorney, Agent, or Firm*—Glenn E. Klepac

(57) ABSTRACT

A process for repairing a hole in the crust of an electrolytic cell. The hole is repaired by covering it with a receptacle containing solid particles.

The receptacle comprises a polymeric material. More preferably, the receptacle comprises a cellulosic material, such as paper, polymer-impregnated paper, or cardboard. A closed paper bag having at least two paper layers and weighing about 15–20 lb. (6.8–9.1 kg) is particularly preferred.

When the electrolytic cell produces aluminum by electrolysis of alumina, the solid particles comprise an aluminum compound such as alumina, aluminum fluoride, cryolite, or a mixture of such compounds. Two preferred forms of alumina include smelting grade alumina (SGA) and alumina dust collected by an electrostatic precipitator (ESP dust).

24 Claims, 2 Drawing Sheets

CRUST HOLE REPAIR FOR ELECTROLYTIC CELLS

FIELD OF THE INVENTION

The present invention relates to the repair of crust holes in electrolytic cells for metal production. Such cells are commonly used for producing aluminum by electrolytic reduction of alumina dissolved in a molten electrolyte.

BACKGROUND OF THE INVENTION

Production of aluminum by electrolysis of alumina is a well-known process. Commercial aluminum production is carried out in a reduction cell by the Hall-Heroult process in which alumina is dissolved in molten cryolite at about 960–980° C. An electric current passing through the molten electrolyte reduces alumina to aluminum which is collected in a pool beneath the molten electrolyte bath.

Electric current enters the cell through an anode in contact with the molten electrolyte, passes downward through the electrolyte, through the pool of molten aluminum, and into a cathode which is formed integrally with the cell bottom. The current leaves the cell through a metal collector bar below the cell bottom and is conducted to an anode in the next of a series of cells making up a pot line.

The cell operating temperature is maintained by resistance heating of the molten electrolyte, electrochemical reactions occurring in the cell, and insulating the cell structure. A frozen crust above the molten electrolyte helps to reduce heat loss because of its insulating effect.

However, the solid crust must be broken periodically to remove molten metal from the metal pool by a vacuum tap. This is achieved by periodically breaking through the solid crust with a crust breaker apparatus. The broken crust collapses down into the molten electrolyte and melts, leaving a hole in the crust above the electrolyte. The crust is also broken periodically when carbon anodes are replaced.

Breaking the solid crust produces holes that increase heat loss from the molten electrolyte. For example, a hole in the crust having an area of only 1 square foot increases heat loss sufficiently that the cell voltage must be increased by about 100 millivolts to maintain cell temperature.

Accordingly, there is a need for a means of repairing crust holes in order to reduce heat loss from the molten electrolyte.

A principal objective of the present invention is to provide an efficient and economical process for repairing crust holes in an electrolytic cell.

A related objective of the invention is to provide a crust hole repair process that avoids contaminating the electrolytic cell with substances that might interfere with cell operation or increase metal impurity levels.

A further objective of the invention is to provide a crust hole repair process that does not pose health or safety risks to pot line workers.

An advantage of the invention is that it offers a means for recovering alumina values in ESP dust collected at alumima refineries and aluminum smelters.

Additional objectives and advantages of our invention will become apparent to persons skilled in the art from the following detailed description.

SUMMARY OF THE INVENTION

In accordance with the present invention there is provided an electrolytic cell wherein a metal is produced by electrolysis. A preferred cell for production of aluminum by electrolysis of alumina comprises a pot defining a chamber containing a molten electrolyte, a cathode, at least one anode contacting the electrolyte, and a solid crust above the electrolyte. The crust comprises solidified electrolyte and alumina, and may build up to a thickness of several inches.

The molten electrolyte comprises sodium fluoride and aluminum fluoride in a weight ratio of about 0.7–1.2, together with lesser amounts of magnesium fluoride and calcium fluoride. The molten electrolyte has a temperature of at least about 900° C., more preferably about 900–1050° C. The electrolyte is preferably maintained at a temperature of about 960–980° C. As reduction takes place, a pad of molten aluminum settles on the cell bottom, above the cathode.

In order to tap molten aluminum from the cell periodically the crust is broken, leaving a hole through which heat is lost from the electrolyte. Cell voltage must then be increased to compensate for the heat loss, resulting in increased electric power consumption.

Heat loss through the crust is reduced by repairing the crust hole. The hole is covered with a receptacle containing a flowable mass of solid particles. The receptacle is preferably closed.

The receptacle comprises a polymeric material. As used herein, the term "polymeric material" includes cellulosic materials, polyolefins such as polyethylene and polypropylene, polyesters such as polyethylene terephthalate, and polyamides.

A preferred receptacle comprises a cellulosic material, more preferably one or more of paper, polymer-impregnated paper, and cardboard. The cellulosic material is derived from wood, reclaimed paper, abaca, jute, or a mixture thereof. A paper bag is particularly preferred.

The paper bag has a plurality of walls, with at least one wall comprising at least two layers of paper. The receptacle and the solid particles together weigh about 11–33 lb (5.0–15.1 kg), preferably about 15–20 lb. (6.8–9.1 kg). The receptacle and the solid particles together provide a covering having a depth of a few inches to several inches over the crust hole, preferably about 2–6 inches (5–15 cm), and about 3 inches (7.5 cm) in a preferred embodiment. Solid particles in the paper bag comprise a flowable mass so that the filled bag is sufficiently flexible to follow the upper contour of the crust.

The electrolytic cell of the invention preferably produces aluminum by electrolyzing alumina dissolved in a molten salt bath electrolyte. Other metals produced by similar electrolytic processes include magnesium, zinc, lithium, and lead.

When the cell produces aluminum by electrolysis of alumina, the solid particles preferably comprise one or more aluminum compounds. Some suitable aluminum compounds includes alumina, aluminum fluoride, cryolite, and mixtures thereof in various proportions. One suitable form of alumina is smelting grade alumina (SGA), typically having an LOI of less than 1 wt. %, 99 $m^2/g$ surface area, average pore (SGA), typically having an LOI of less than 1 wt. %, 99 $m^2/g$ surface area, average pore volume 0.224 $cm^3/g$, average pore size about 92 microns, and −100+325 mesh size. SGA is commonly used as a feedstock for aluminum smelters. Another suitable form of alumina is electrostatic precipitator dust (ESP dust) obtained from pollution control devices in aluminum smelting plants and in aluminum refineries.

DETAILED DESCRIPTION OF PREFERRED EMBODIMENTS

Figure 1:
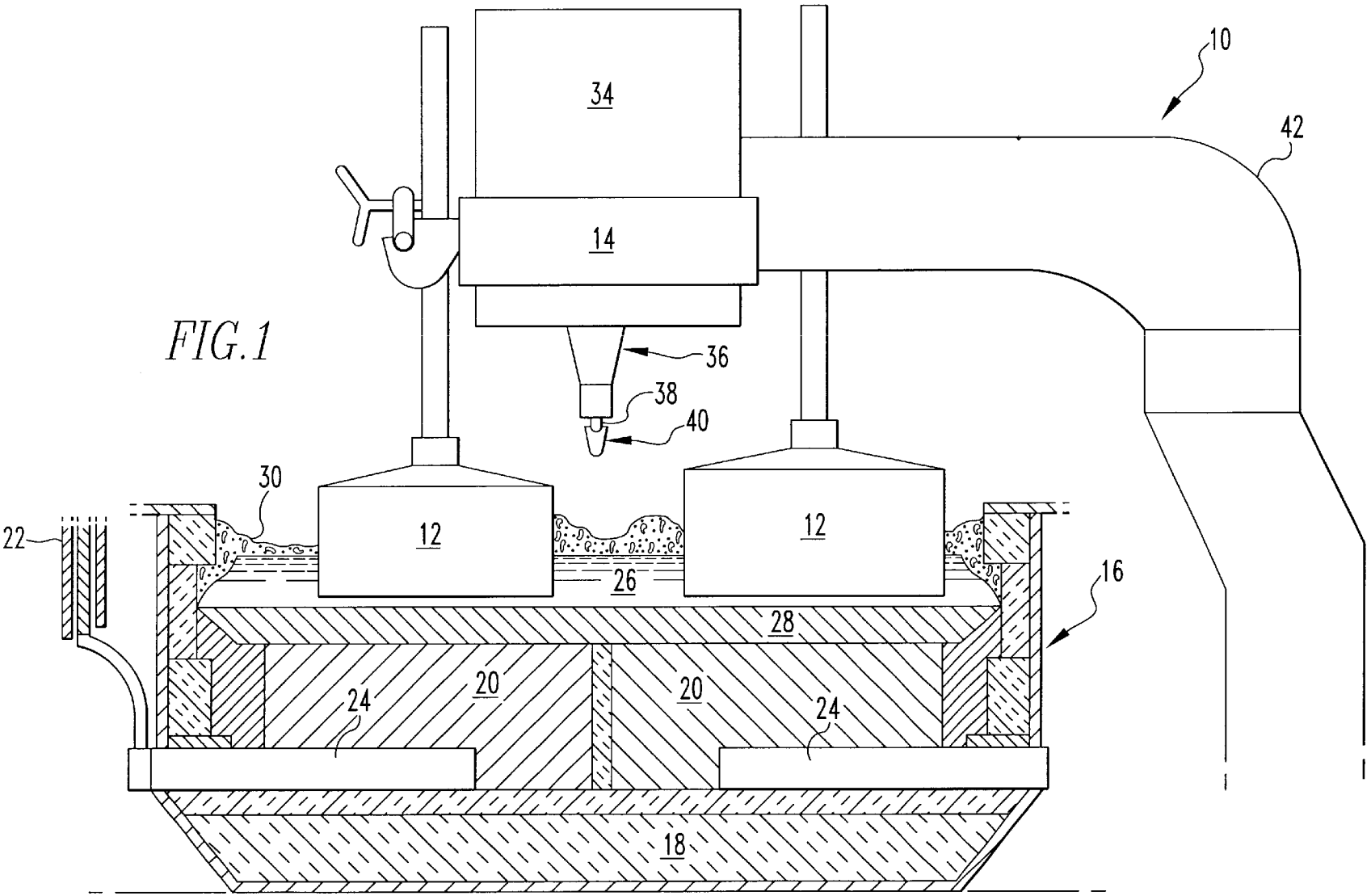
FIG. 1 is a schematic cross-sectional view of an electrolytic cell of the invention.

There is shown in FIG. 1 an electrolytic cell 10 for aluminum production, having carbon anodes 12 suspended from a movable bridge 14. The anodes 12 are situated above a pot or cell 16 lined with a layer of insulating material 18 upon which solid carbon cathode blocks 20 are positioned. The cathode blocks 20 are connected in an electrical circuit with an external bus 22 via steel collector bars 24 passing through the cathode blocks 20.

A bath 26 of molten cryolite containing dissolved alumina is maintained at approximately 950–960° C. within the pot 16 and as reduction takes place a pad 28 of molten aluminum settles over the cathode blocks 20. A layer of crust 30 forms above the bath 26, surrounding the carbon anodes 12. The crust 30 generally has a thickness of several inches.

The movable bridge 14 is vertically adjustable to enable the carbon anodes to be elevated or lowered relative to the height of the bath 26. An overhead hopper 34 supported between the carbon anodes 12 is filled with alumina ore. Alumina ore from the hopper is 34 periodically added to the bath 26 as needed through a feeder mechanism 36. The feeder mechanism 36 includes a downwardly projecting steel rod 38 supporting a ceramic plugger foot 40. When alumina ore is added to the bath 26, the steel rod 38 and plugger foot 40 are thrust downwardly to punch a hole through the crust 30. An overhead conveyor 42 supplies alumina ore to the hopper 34 as needed.

Tapping molten aluminum from the metal pad 28 requires breaking the crust 30 to insert a vacuun tap (not shown). In a typical Hall-Heroult electrolytic cell, molten aluminum is tapped approximately every 24 hours. After the tap is removed, a hole remains in the crust 30 above the molten electrolyte 26. Holes left over from molten metal tapping typically have dimensions of about 12 in×12 in (30 cm×30 cm).

Figure 2:
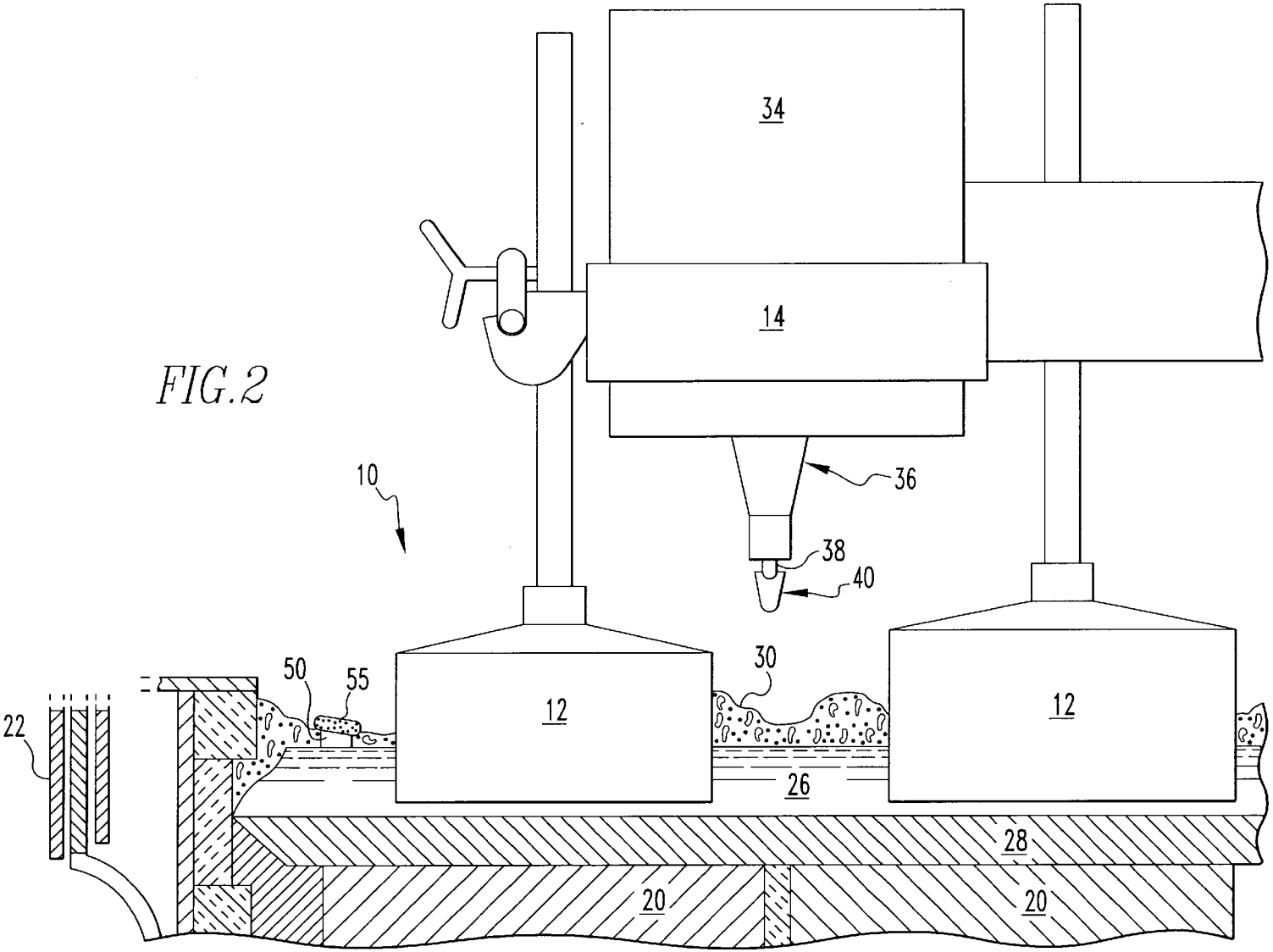
FIG. 2 is a schematic, fragmentary cross-sectional view of the electrolytic cell of FIG. 1.

In accordance with the present invention, a hole 50 in the crust 30 is repaired by placing a paper bag 55 directly above the hole 50 as shown in FIG. 2. The bag 55 is double walled on all sides and is filled with approximately 20 lb (9.1 kg) of a mixture of smelting grade alumina and crushed molten salt bath. A mixture of about 10 lb (4.5 kg) SGA and 10 lb (4.5 kg) crushed molten salt bath is quite suitable.

Alumina and bath particles in the bag 55 are sintered into a porous mass by heat from the molten electrolyte 26. The bag 55 remains intact for a sufficient time to prevent the solid particles from scattering. Eventually, the bag 55 is oxidized, some of the solid particles merge with the crust 30 and some of the solid particles drop down into the molten electrolyte 26. Containing the particles in the paper bag 55 eventually restores the crust 30 to an unbroken, unitary mass without imbalancing alumina content in the electrolyte 26.

Having described the presently preferred embodiments, it is to be understood that the invention may be otherwise embodied within the spirit and scope of the appended claims.

What is claimed is:

1. In an electrolytic cell wherein a metal is produced by electrolysis, said cell comprising a molten electrolyte at an elevated temperature and above said electrolyte a crust defining a hole through which heat is lost from said electrolyte, the improvement in the operation of said cell comprising repairing said hole by covering it with a receptacle containing solid particles comprising alumina.

2. The improvement of claim 1, wherein said receptacle comprises a polymeric material.

3. The improvement of claim 2, wherein said polymeric material comprises a cellulosic material.

4. The improvement of claim 3, wherein said receptacle comprises a cellulosic material selected from the group consisting of paper, polymer-impregnated paper, and cardboard.

5. The improvement of claim 3, wherein said cellulosic material is derived from wood, reclaimed paper, abaca, jute, or a mixture thereof.

6. The improvement of claim 1, wherein said receptacle is closed.

7. The improvement of claim 1, wherein said receptacle comprises a paper bag.

8. The improvement of claim 7, wherein said paper bag has a plurality of walls and at least one of said walls comprises at least two layers of paper.

9. The improvement of claim 1, wherein said receptacle and said solid particles together weigh about 11–33 lb. (5.0–15.1 kg).

10. The improvement of claim 1, wherein said receptacle and said solid particles weigh about 15–20 lb. (6.8–9.1 kg).

11. The improvement of claim 1, wherein said receptacle and said solid particles comprise a covering having a depth of about 2–6 in. (5–15 cm) over said hole.

12. The improvement of claim 1, wherein said molten electrolyte has a temperature of at least about 900° C. and heat from said electrolyte sinters said solid particles.

13. The improvement of claim 1, wherein said molten electrolyte has a temperature of about 900–1050° C.

14. The improvement of claim 1, wherein said electrolytic cell produces aluminum by electrolysis of alumina, and said solid particles further comprise an aluminum compound selected from the group consisting of aluminum fluoride, cryolite, and mixtures thereof.

15. The improvement of claim 14, wherein said aluminum compound is selected from the group consisting of alumina, aluminum fluoride, cryolite, and mixtures thereof.

16. The improvement of claim 1, wherein said solid particles comprise ESP dust.

17. The improvement of claim 1, wherein said crust supports said receptacle above said electrolyte.

18. The improvement of claim 17, wherein said receptacle is spaced from said electrolyte.

19. An electrolytic cell for producing a metal by electrolysis, said cell comprising a chamber containing a molten electrolyte at an elevated temperature, above said electrolyte a crust defining a hole, and a covering for said hole comprising a receptacle containing solid particles, said crust supporting said receptacle upward of and spaced from said electrolyte, thereby reducing heat loss from said electrolyte through said hole.

20. The cell of claim 19, wherein said receptacle comprises a cellulosic material selected from the group consisting of paper, polymer-impregnated paper, and cardboard.

21. The cell of claim 19, wherein said cell produces aluminum by electrolysis of alumina dissolved in said molten electrolyte, and said molten electrolyte has a temperature of at least about 900° C.

22. The cell of claim 19, wherein said solid particles comprise an aluminum compound selected from the group consisting of alumina, aluminum fluoride, cryolite, and mixtures thereof.

23. The cell of claim 19, wherein said solid particles comprise alumina.

24. The cell of claim 23, wherein said solid particles further comprise aluminum fluoride or cryolite.

* * * * *